United States Patent [19]

Collier et al.

[11] Patent Number: 5,035,649

[45] Date of Patent: Jul. 30, 1991

[54] SHIELDED ELECTRICAL CONNECTORS

[75] Inventors: John C. Collier, Southport; Stuart J. Reeves, St. Helens, both of United Kingdom

[73] Assignee: ITT Industries Limited, Basingstoke, United Kingdom

[21] Appl. No.: 459,913

[22] Filed: Jan. 2, 1990

[30] Foreign Application Priority Data

Jan. 10, 1989 [GB] United Kingdom ..... 8900450

[51] Int. Cl.[5] ..... H01R 13/648

[52] U.S. Cl. ..... 439/607; 439/290

[58] Field of Search ..... 439/638, 639, 652, 654, 439/676, 78, 79, 931, 86, 88, 607, 610, 59, 60, 61, 62, 629–637, 289, 290, 291

[56] References Cited

U.S. PATENT DOCUMENTS

| | | | |
|---|---|---|---|
| 3,208,030 | 9/1965 | Evans et al. | 439/290 |
| 3,634,811 | 1/1972 | Teagno et al. | 439/290 |
| 3,663,921 | 5/1972 | Richard | 439/62 |
| 4,457,575 | 7/1984 | Davis et al. | 439/676 |
| 4,460,234 | 7/1984 | Bogese | 439/676 |
| 4,679,879 | 7/1987 | Triner et al. | 439/607 |
| 4,838,811 | 6/1989 | Nakamura et al. | 439/607 |
| 4,895,532 | 1/1990 | Bogese | 439/638 |

FOREIGN PATENT DOCUMENTS

| | | | |
|---|---|---|---|
| 2176350 | 12/1986 | United Kingdom | 439/629 |

*Primary Examiner*—Larry I. Schwartz
*Assistant Examiner*—Hien D. Vu
*Attorney, Agent, or Firm*—Thomas L. Peterson

[57] ABSTRACT

An RF screened plug-in connector comprises a plug (14, FIG. 2A) and a socket connector device (44) that includes a socket (15) and a circuit board (16). The plug is on the end of a screened cable (3), the screen of which is internally connected to a conductive surface (9) of the plug. The socket has a body (18) which is open to provide access to conductive tracks (17) on the circuit board (16). The body has an internal conductive surface portion (21*a*) which is pressed into intimate contact with a conductive surface portion (9*a*) on the plug, by virtue of the reaction between resilient contact fingers (12) on the plug pressing on the tracks (17) on the board. The socket body (18) is held in contact with the board (16) by latches (20, FIG. 2C) which also have conductive surfaces and which contact a conductive layer (42) on the underside of the board.

7 Claims, 4 Drawing Sheets

SHIELDED ELECTRICAL CONNECTORS

BACKGROUND OF THE INVENTION

This invention relates to shielded electrical connectors.

Shielding, or screening, to reduce RF interference is an increasing requirement in data equipment. Shielding of connectors is most commonly provided by means of inter-fitting metal casings as exemplified by EP0112713. EP0112648 shows an alternative design of a shielded connector in which a one-piece metallic casing is provided with two hinge portions so that it can be hinged to form an enclosure surrounding the conductors contained within the electrical connector. A disadvantage of these shielded connectors is that any imperfections in the fitting together of the metallic casings could create slot antennae, which may actually emit interference.

An attempt to circumvent this problem is disclosed in EP0090539, in which a two-part casing is provided with a stepped peripheral flange. The flange produces a more closely inter-fitting casing with less tendency to produce slot antennae. The casing is formed of an insulating material, plated with conductive material on the inside surfaces thereof.

The present invention seeks to provide an improved shielded electrical connector having none of the disadvantages associated with inter-fitting shielding casings.

SUMMARY OF THE INVENTION

In accordance with one embodiment of the present invention, a connector system with two mating connector devices is provided, which effectively connects shieldings of the connector devices. One of the connector devices has resilient contacts for engaging contacts on the other connector device. The force of the resilient contacts presses conductive surfaces of the two devices into intimate engagement. The connector devices may be connectors or circuit boards with multiple contacts.

The novel features of the invention are set forth with particularity in the appended claims. The invention will be best understood from the following description when read in conjunction with the accompanying drawings.

DESCRIPTION OF THE PREFERRED EMBODIMENT

Figure 1:
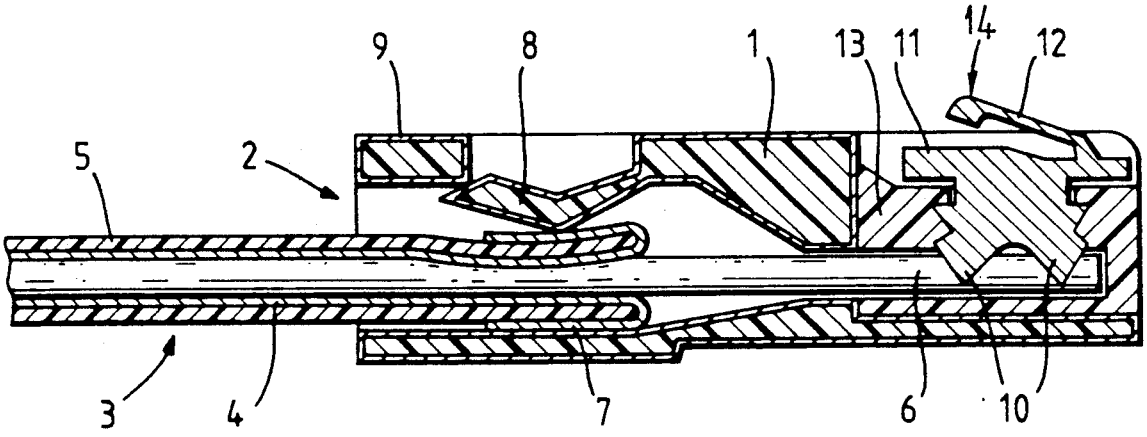
FIG. 1 is a sectional side view of a shielded plug constructed in accordance with one embodiment of the present invention.

FIG. 1 shows a shielded plug connector device or plug 14 that includes a housing 1 having an opening 2 that receives an inserted end of a cable 3. The cable includes at least one wire 6, an insulating sheath 5 around the wires, and a metallic braided screen 4 around the sheath. Prior to insertion of the cable end, the screen and sheath are cut back to expose the wires 6. The sheath 5 is cut back further than the screen 4 to allow the screen to be folded back over the end of the sheath as shown at 7.

The plug housing 1 includes a resilient integral strain-relieving part 8 that presses against the inserted cable to retain it in the plug housing. The left hand portion of the housing 1 has a continuous electrically-conductive coating 9 which may be applied by a plating process on a plastic housing portion. This conductive surface 9, which covers the inside of the strain relieving part 8, provides an electrically-conductive path between the folded-over end 7 of the screen and the exterior of the plug housing 1.

The extreme ends of the cable wires 6 enter a blind bore in the right hand portion of the plug housing where each wire is engaged by tangs 10 of an insulation-piercing contact that pierces insulation of the wire to contact a conductor in the wire. Each contact 11 includes a resilient contact finger 12 that is integral with the tangs 10 and which normally projects from the outer surface of the plug.

The right hand portion of the plug housing 1 is left unplated (except possibly at its extreme end) in order to prevent short-circuiting of the contact 11 The housing includes a separate insert 13 of insulating material in which the contact 11 is mounted.

Figure 2A:
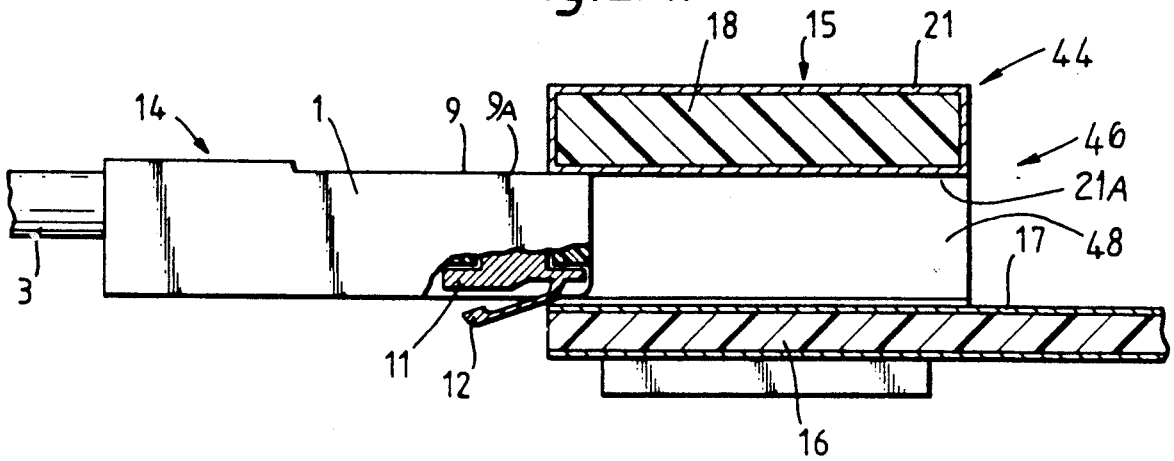
FIGS. 2A, 2B and 2C are views of a connector system which includes the shielded plug of FIG. 1.
Figure 2B:
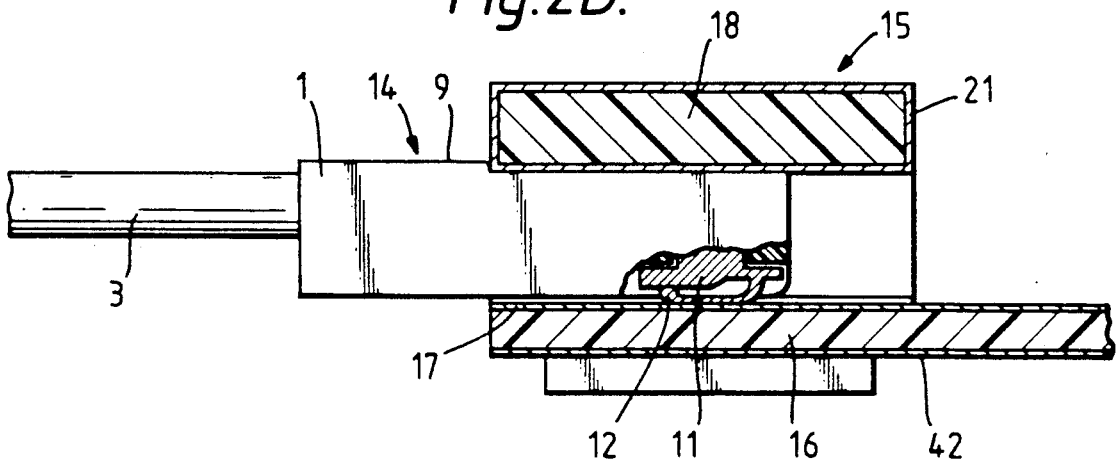
Figure 2C:
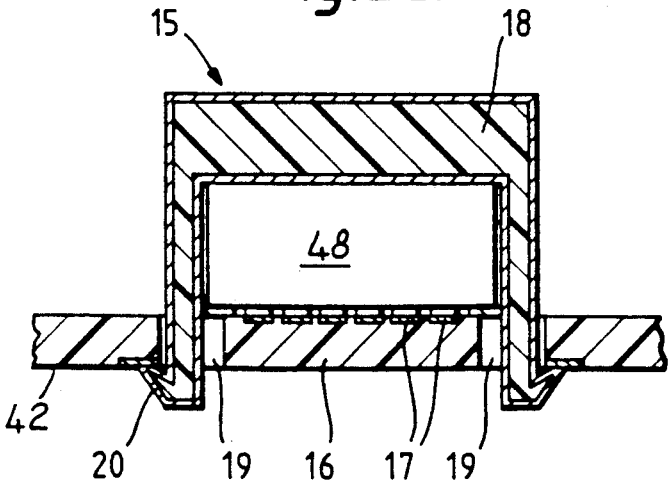

FIGS. 2A, 2B and 2C show the first component or plug 14 cooperating with a second component or connector device 44 which includes a socket 15 and a printed circuit board 16, which are all part of a connector system 46 that includes the plug. The socket 15 is shown in side sectional views in FIGS. 2A and 2B and in an end sectional view in FIG. 2C. In FIG. 2A, the plug is shown at the start of insertion in the socket, and in FIG. 2B the plug is shown fully inserted.

The socket 15 is adapted to be mounted on a printed circuit board. 16 provided with contacts in the form of conductive traces 17. As is most evident from FIG. 2C, the socket comprises an insulative housing or body 18 of substantially U-shaped section (the right side of the enclosure of FIGS. 2A and 2B can be closed). The socket can be attached to the board by inserting vertical sides of the socket body through corresponding slots 19 in the board. Latches 20 of the lower ends of the socket body sides retain the socket in its fully inserted position relative to the board. The socket and circuit board together form an enclosure 48 for receiving the plug. (The right side of the enclosure of FIGS. 2A and 2B can be closed). The socket body 18 is open at the bottom. Traces 17 on the board are exposed so that when the plug 14 is inserted as shown in FIGS. 2A and 2B, contact fingers 12 of contacts 11 of the plug make resilient contact with the conductive traces 17.

The socket body 18 is coated internally and externally e.g. by plating, to provide a continuous electrically-conducting surface 21 which makes direct contact with the conductive surface 9 on the inserted plug. This provides a continuous conductive path between the screen of the cable 3, the exterior conductive surface 9 of the plug 14, and the interior conductive surface **21*a* of the socket 15. The resilient contact fingers 12 of the plug press in a downward direction against the conductive traces 17 of the circuit board. The downward pressing of the resilient contacts 12 results in a reactive upward force on the plug housing 1. This results in the upper conductive surface portion 9*a* of the plug housing being pressed against the conductive lower internal surface portion 21*a* of the socket housing or body. Such reactive forces are created because the contacts 12 press in only one direction against the mating traces or contacts 17. The conductive coating on the exterior of the body 18 is continued over the latches 20 which, in turn, are pressed into engagement with a screening conductive layer 42 on the underside of the board 16**.

In an alternative construction to that shown, the entire socket 15 may be made of electrically conductive material. Similarly the housing 1 of the plug may be made of solid conductive material (except for insert 13, whose front may be coated with metal).

Figure 3A:
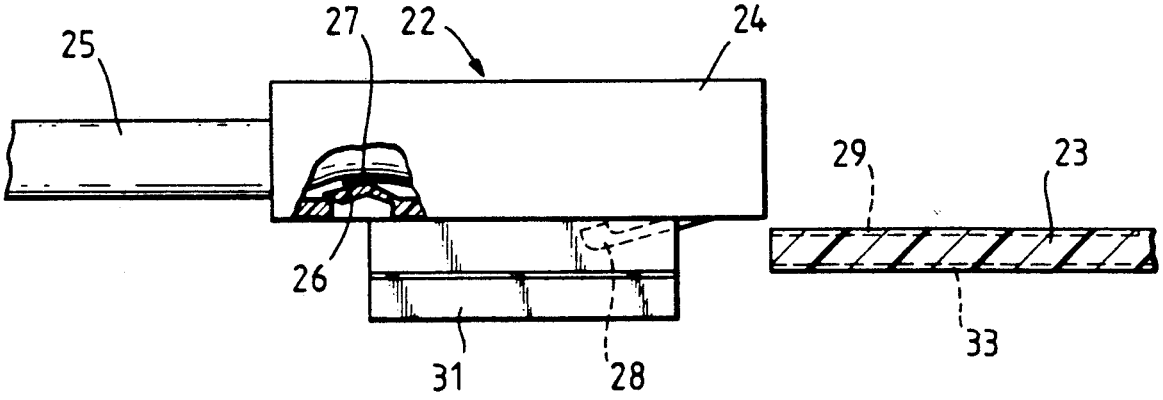
FIGS. 3A, 3B and 3C are views of another connector system.
Figure 3B:
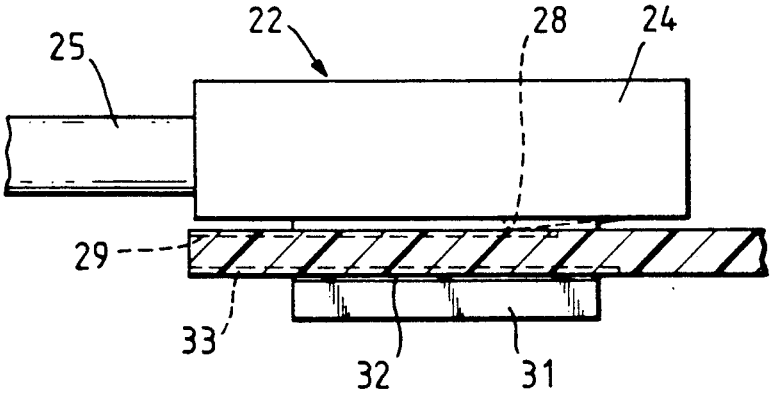
Figure 3C:
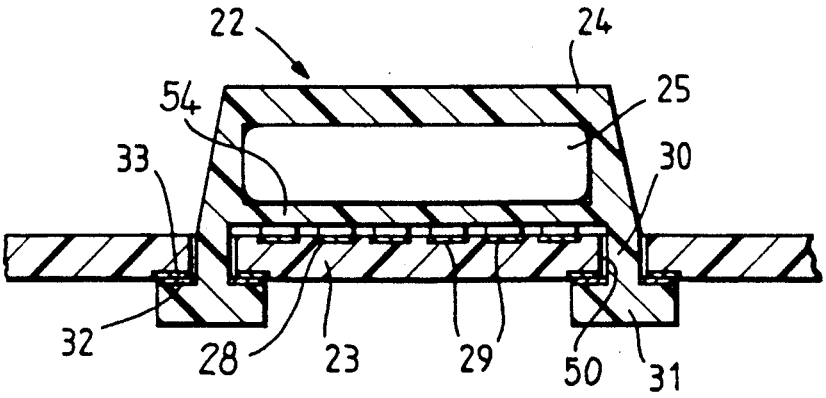

FIGS. 3A, 3B and 3C show a unitary shielded component or plug device 22 for mounting on a printed circuit board component 23, FIGS. 3A and 3B being diagrammatic side views and FIG. 3C an end elevation view.

The plug or plug device 22 is an assembly that comprises a housing 24 of plated insulating material similar to the housing 1 of the plug in FIGS. 1, 2A, 2B and 2C. A cable end 25 of a flat cable, is received in the plug assembly housing 24 and retained therein by a strain-relieving housing part 26 (FIG. 3A) in the same way as described in relation to FIG. 1. The part 26 is coated with a conductive layer contiguous with a layer on the exterior of the housing so that, as described above, there is a continuous screening path between the folded back end of the screen 27 on the cable and the exterior of the housing. As described above, the conductive coating on the exterior of the housing is interrupted in the region of resilient contact fingers 28.

The plug 22 is arranged to be slid over the edge of the printed circuit board component or board 23 so that the contact fingers 28 can mate with conductive tracks 29 on the board as shown in FIGS. 3B and 3C. Alternatively, the arrangement can be regarded as one in which the printed circuit board is received in the plug.

The plug housing 24 is provided with downwardly-extending arms 30 (FIG. 3C) which engage in slots 50 in the board 23. The arms 30 terminate in feet plug portions 31 which are pressed upwardly against the bottom of the board 23 by the resilient force exerted by the contact fingers 28. The contact fingers are mounted on another plug portion 54 of the plug housing. The upper surfaces of the feet portions 31 are conductively coated by plating or the like as shown at 32, which coating is contiguous with the coating on the exterior of the housing 24. The upward pressure exerted on the feet portions or feet 31 causes the coating 32 to be forced into conductive engagement with a screening layer 33 on the underside of the board 23. In this way a continuous conductive path is formed from the screen of the cable 25 through the coating on the housing 24 to the screen coating 33 on the printed circuit board.

Figure 4A:
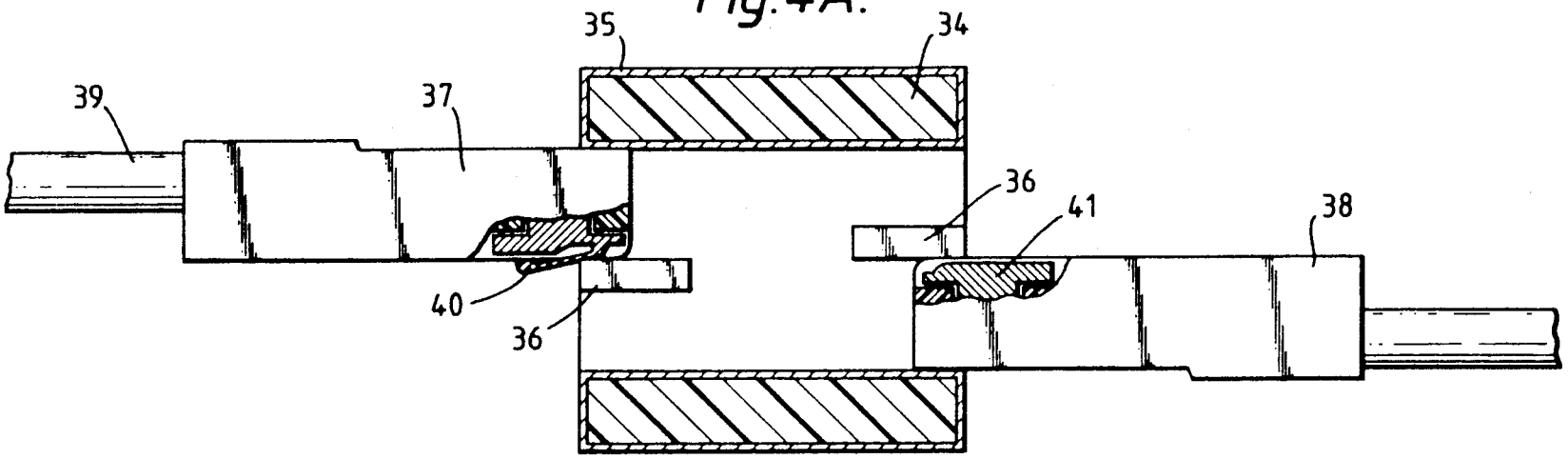
FIGS. 4A and 4B are views of another connector system.
Figure 4B:
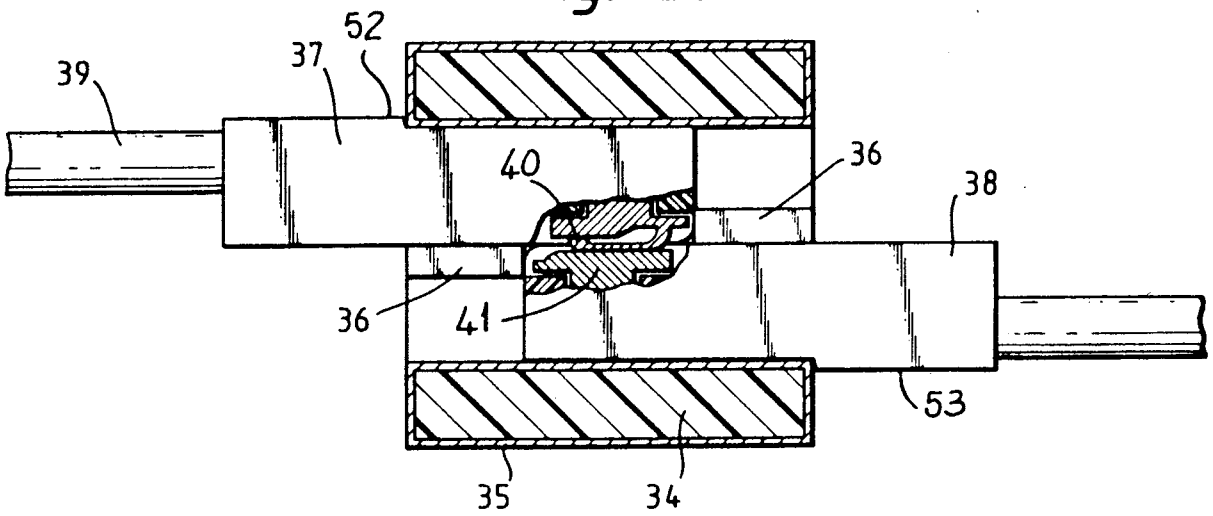

FIGS. 4A and 4B are side sectional views of a double plug and socket connection of the kind used in the type of variable interconnection referred to as "patching".

A double socket housing 34 is made of metal or coated with a conductive layer to form a conductive surface 35. The housing is provided with guides 36 to receive in parallel relationship plugs 37 and 38 inserted from opposite ends and in inverted relationship. FIG. 4A shows the plugs at the beginning of their insertion while FIG. 4B shows the plugs in their final or fully inserted position.

First plug 37 is a component of the type described in FIGS. 1, 2A, 2B and 2C. It is provided with a housing part 52 with an external conductive coating connected to the screen of its cable 39, the coating being interrupted in the vicinity of one or more resilient contact fingers 40.

Second plug 38 is of similar design to first plug 37 except that the resilient contact fingers 40 are replaced by one or more fixed contacts 41. The second plug 38 and double socket housing 34 form a second connector device or component that mates with the first component or plug 37.

When the two plugs are fully inserted as shown in FIG. 4B, the contact fingers 40 resiliently engage corresponding fixed contacts 41 on the other plug. At the same time, this resilient engagement produces a reaction tending to press the two plugs apart and forcing their non-contact sides into close contact with conductive surface portions of the housing 34. This not only results in the plugs being held firmly in the housing, but also results in the conductive or screening layers 52, 53 on the exteriors of the plugs making good contact with the screening layer 35 on the double socket housing.

Thus, the invention provides connector systems wherein one or more contacts on a first connector component or device engage corresponding contacts on a second connector component or device, wherein good contact is made between RF screening material on the mating devices in a low cost and reliable construction. The two connector devices have housings with RF-shielding or screening conductive surfaces, and their mating contacts include a set of contacts with resilient fingers. The force of the resilient fingers on one connector device pressing in a first direction against contacts on the other device, presses a conductive surface of the first device in a second direction against a conductive surface of the other device. A cable with a screen around its wires, has its screen connected to a housing conductive surface by a conductive surface on a strain-relieving integral part of the housing.

Although particular embodiments of the invention have been described and illustrated herein, it is recognized that modifications and variations may readily occur to those skilled in the art, and consequently, it is intended that the claims be interpreted to cover such modifications and equivalents.

We claim:

1. A shielded electrical connector comprising: plug and socket connector components which may be mated by causing the plug component to fit inside the socket component, said plug component having at least one resilient contact adapted to engage a relatively fixed contact carried by the socket component when the components are mated, each component having a conductive surface insulated from its corresponding contact, with said conductive surfaces lying adjacent to each other when the components are mated, and said conductive surfaces are pressed into engagement with each other by reaction to the force between said resilient and fixed contacts;.

said plug component being located on one end of a screened cable and said plug component having an external conductive layer forming one of said conductive surfaces and connected to the screen of the cable;

said socket component has an interior conductive layer forming one of said conductive surfaces and contacting the conductive layer on the plug component;

said socket component is formed jointly by a housing having a plug-receiving enclosure with a conductive surface and a printed circuit board which the housing is attached, said fixed contact comprising a conductive track on the printed circuit board which is exposed within the housing; and a screening layer on the side of said printed circuit board remote from said conductive track, said housing having latches with metal surfaces which are pressed into engagement with said screening layer.

2. A shielded electrical connector comprising:

a pair of connector components which may be mated by causing one component to fit inside the other, one of the components having a t least one resilient contact adapted to engage a relatively fixed contact carried by the other component when the components are mated, each component having a conductive surface insulated from its corresponding contact, with said conductive surfaces lying adjacent to each other when the components are mated, and said conductive surfaces are pressed into engagement with each other by reaction to the force between said resilient and fixed contacts;

one of said components is a portion of a printed circuit board having said fixed contact which is in the form of a conductive trace on one side of the board and having a conductive screening layer on the other side of the board; and the other said components is a plug assembly having a pair of spaced plug portions, with said resilient contact mounted on a first of said plug portions and engaging said conductive trace of said board and with said second plug portion having a conductive surface pressed into engagement with said screening layer on said board.

3. A shielded electrical connector comprising:

a pair of connector components which may be mated by causing one component to fit inside the other, one of the components having at least one resilient contact adapted to engage a relatively fixed contact carried by the other component when the components are mated, each component having a conductive surface insulated from its corresponding contact, with said conductive surfaces lying adjacent to each other when the components are mated, and said conductive surfaces are pressed into engagement with each other by reaction to the force between said resilient and fixed contact;

one of said components is a first plug which has said resilient contact, and the other component includes a second plug and a double socket into which said first and second plugs can be inserted so as to bring said resilient contact on said first plug into engagement with said fixed contact on said second plug, each of said plugs having an external conductive surface and said double socket having a conductive surface with portions that are positioned to engage said plug conductive surfaces, so that when the plugs are inserted into the double socket the reaction between the contacts forces the conductive surfaces on both plugs into contact with the conductive surface of the double socket.

4. A shielded electrical connector system comprising:

a pair of mateable connector devices that include mateable contacts and housing with conductive surfaces;

a first of said connector devices having a first resilient contact that presses in a first direction against a second contact of the second connector device, and said first connector device housing having a first conductive surface portion that is pressed in a second direction by the force of said resilient contact against said second contact, into engagement with a second conductive surface portion of said second connector housing;

said first connector device comprises a plug and said second connector device comprises a circuit board with a first face having conductive traces with one of said traces forming said second contact, said circuit board having a second face with a conductive coating;

said board having a pair of slots and said plug having a pair of feet that can project through said slots, said feet forming said second conductive surface portion and being pressed in said second direction against said conductive coating on said circuit board second face.

5. An electrical connector comprising:

a plug-receiving enclosure comprising a circuit board and a socket mounted on said circuit board, to leave inner walls between said board and socket for receiving a plug, and said circuit board surface having a conductive trace;

a plug constructed to fit into said enclosure between said board and socket, said plug having a resilient contact positioned to directly engage said conductive trace on said circuit board.

6. The electrical connector described in claim 5 wherein:

at least a portion of the inner surface of said socket is conductive;

said plug is located on an end of a screened cable and has an external conductive layer connected to the screen that is positioned to engage said socket conductive inner surface portion.

7. An electrical connector system comprising:

first and second plugs, said first plug having a resilient contact and said second plug having a second contact;

a double socket housing having guides that guide said first and seconds plugs along parallel paths into adjacent final positions wherein said resilient contact of said first plug presses against said second contact of said second plug;

said plugs each have an external conductive surface opposite its respective contact;

said double socket contact has conductive portions lying beside said plug conductive surface, with the force of said first plug resilient contact against said second contact serving to press said conductive surface of said first and second plugs against said double socket housing conductive surfaces.

* * * * *